US005186460A

United States Patent [19]

Fongeallaz et al.

[11] Patent Number: 5,186,460

[45] Date of Patent: Feb. 16, 1993

[54] COMPUTER-CONTROLLED RACING GAME

[76] Inventors: Laura Fongeallaz; Carl Fongeallaz, both of 22 Gibson Place, Glen Rock, N.J. 07452; Albert Weinstein, Box J, Stanfordville, N.Y. 12581

[21] Appl. No.: 741,611

[22] Filed: Aug. 7, 1991

[51] Int. Cl.[5] ..... A63F 9/22

[52] U.S. Cl. ..... 273/86 B; 273/85 G; 273/434; 273/DIG. 28

[58] Field of Search ..... 273/85 G, 86 R, 86 B, 273/138 A, 246, 248, 259, 433, 434, 237, DIG. 28

[56] References Cited

U.S. PATENT DOCUMENTS 3,463,496 8/1969 Weinstein et al. ..... 273/246
3,770,269 11/1973 Elder ..... 273/138 A
4,373,723 2/1983 Brown et al. ..... 273/86 B
4,844,462 7/1989 Lubniewski ..... 273/86 B

FOREIGN PATENT DOCUMENTS 0059779 8/1982 European Pat. Off. ..... 273/86 R
0065862 12/1982 European Pat. Off. ..... 273/86 R
2004444 3/1979 United Kingdom ..... 273/86 B

*Primary Examiner*—Theatrice Brown
*Assistant Examiner*—Jessica J. Harrison

[57] ABSTRACT

A computerized racing game provides a display of contestants who move from a start to a finish position in response to chance factors determined by the computer and strategical inputs supplied to the computer by the players. The latter is implemented by allocating a reserve of energy to each contestant, and allowing each player to determine the rate at which the energy is consumed.

12 Claims, 15 Drawing Sheets

COMPUTER-CONTROLLED RACING GAME

This invention relates to a computer-controlled racing game for simulating an actual race.

BACKGROUND OF INVENTION

Reference is made to U.S. Pat. No. 3,463,496, whose contents are herein incorporated by reference. This patent describes a non-computerized board racing game for multiple players using dice to provide a chance factor, and providing various devices to allow strategical skills of a player to contribute to the outcome of the race.

SUMMARY OF THE INVENTION

An object of the invention is a computer-controlled racing game combining chance and strategical factors to closely simulate the actual happenings of a true racing contest.

A further object of the invention is a computer-controlled racing game allowing one or more players to compete with each other or with the computer.

Another object of the invention is a computer-controlled racing game which will allow many modifications to the race conditions to enhance amusement and excitement.

Still a further object of the invention is a computer-controlled racing game which displays the race course, representations of the race contestants, and movement of the contestant representations smoothly over the course in response to player or computer inputs.

In accordance with one aspect of the invention, each contestant occupies a certain space on the display, but is surrounded by additional space owned by the contestant into which no other contestant can enter. This feature prevents contestant representations from being spoiled and also implements realistic contestant blocking. It also provides a mechanism for detecting improper or illegal actions by a player.

In accordance with another aspect of the invention, certain locations on the course are designated as free spaces, in which entry of a contestant to a free space causes automatic limited movement in a given direction. This feature enables simulation of course geometries wherein certain contestant positions have advantages over other positions. It also enables simulation of specific race conditions.

A further aspect of the invention is to provide each contestant with a predetermined amount of energy. This greatly simplifies the problem of maintaining a minimum level of fairness to enable any contestant to prevail. Another aspect of this feature is to modify the energy reserve of contestants during the running of the race. This allows rewarding or penalizing players for actions taken during the race.

Still another aspect of the invention is to distribute among the contestants the results of a random operation, which determines the progress of each contestant. This also contributes to a display which provides for smooth movements of the contestant representations.

Still a further aspect is a mechanism for providing a photofinish for contestants within a prescribed distance from the finish line to enhance excitement of the game for the players.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there are illustrated and described the preferred embodiments of the invention.

DETAILED DESCRIPTION OF PREFERRED EMBODIMENTS

As in the referenced patent, the particular embodiment which we will describe hereinafter is a horse racing game, but it will be understood by those skilled in the art that the present invention is not limited to a horse racing game but may be employed as an auto racing, boat racing, or in general as any kind of a racing game using representations to simulate animals or vehicles.

The present invention borrows certain basic concepts disclosed in the referenced patent, but most require considerable modification when applied to a computer-controlled game as distinguished from a board game. Nevertheless, the reader is urged to read said U.S. Pat. No. 3,463,496 so that some of the terms and concepts described therein will become more meaningful and understandable.

Figure 11:
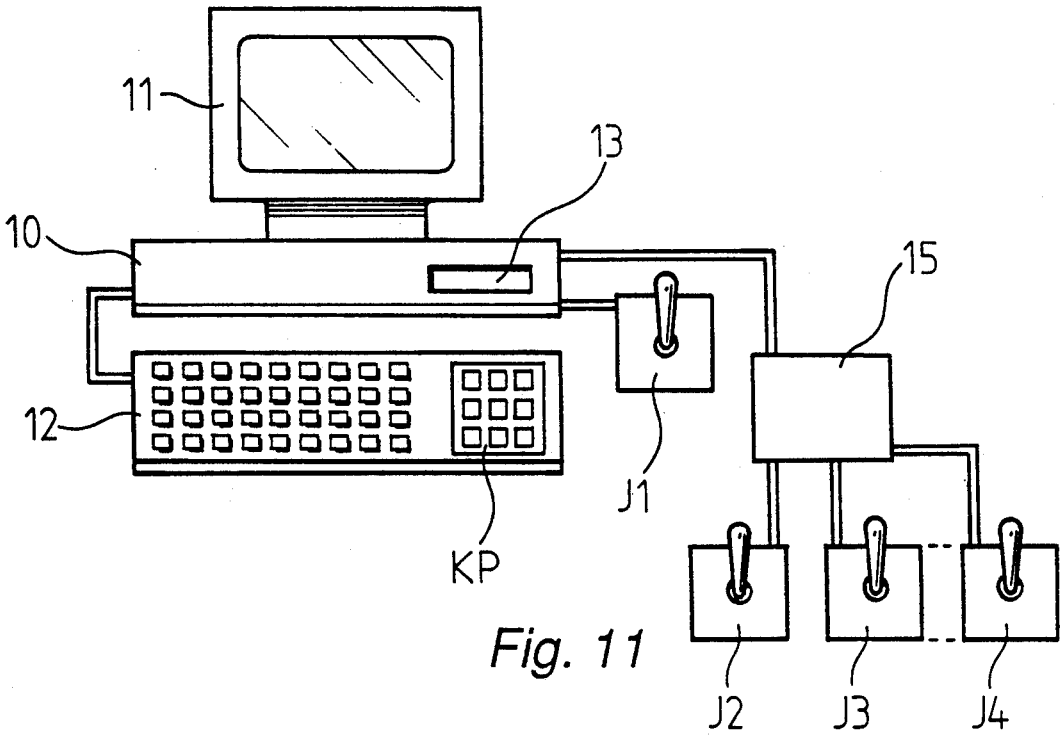
FIG. 11 is a block diagram showing the hardware needed for the game of FIGS. 1-10.
Figure 12A:
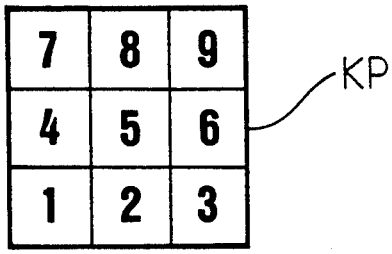
FIGS. 12A and 12B illustrate control positions for game players.
Figure 12B:
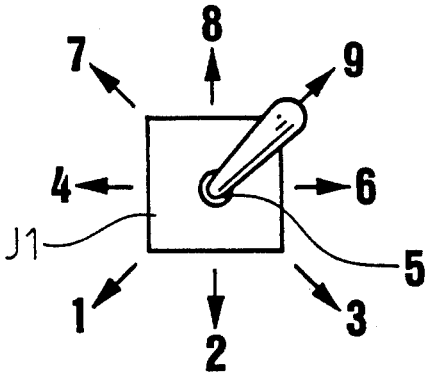

Referring now to FIGS. 11 and 12A, the apparatus for implementing the game is a personal computer 10 (PC) with graphics display 11 capability and the usual keyboard 12. The game program 13, when executed on the computer 10, performs all the necessary tasks which will be described below. Basically these tasks consist of determining and identifying the number of horses (contestants), displaying on the monitor screen 11 the horses on at least part of the track as realistically as possible (representations), and then causing the horses to move along the track as the race progresses in response to a chance factor and strategical inputs from the players via the keyboard 12 or preferably a joystick J1 connected to the computer 10. Each player will be given a joystick which he or she (s/he) will manipulate during the race to control their assigned horse. While many alternatives will be evident to those skilled in the art, one relatively simple mechanism to control a player's horse is to program the computer to recognize nine joystick positions as defined in FIGS. 12A and 12B. When the joystick J1 is moved from its center or neutral position corresponding to position 5 in FIG. 12B to any other of the eight positions, while the joystick is held in one of its nine positions the computer will interpret that as a player's command meaning the following. The forward or up positions (7,8,9) are for the fastest speed. The center positions (4,5,6) are for medium speed. The bottom positions (1, 2, 3) are for the slowest speed. The left positions (1,4,7) are for moving "in." The center positions (2,5,8) are for moving straight. The right positions (3,6,9) are for moving "out."

This implementation will require multiple ports on the computer equal in number to the number of joysticks. Alternatively, a single piece of hardware 15 can be provided which connects to the computer's serial port, and which contains multiple connectors for receiving multiple joysticks J2 . . . J4. In this implementation, the hardware 15 would essentially poll each joystick, determine its position, and transmit the information, serially, to the computer 10.

As a further alternative, for just one or two or three players, a single joystick J1 alone, or the keyboard 12 alone, or a second joystick J2, or two or three of them can be used. With a keyboard 12, one simple implementation is as follows. Use the numeric keypad KP in "NUM LOCK" mode (the horse will not respond when "NUM LOCK" is off.) The numeric keys 1–9 are used as in the joystick control example. When using the keyboard, only hit the keypad when you want to change the direction or speed that you last entered. (Don't continuously hit the keypad.) Examples: 1) Joystick in center, center position or keypad enters 5: Horse will move straight at medium speed. 2) Joystick in up, left position or keypad enters 7: horse will move in at fast speed. (Moving in is moving toward the rail at the top of the screen.)

It will be understood that the invention is not limited to these examples for implementing commands of a player.

For displaying the positions of the various horses and their movements during the race, it is necessary to store the location of each horse before and after each move during the progress of the race. In a preferred embodiment of the invention illustrated in FIG. 13, we use a two-dimensional array AR which mimics the race track or course. We will now describe how this is done with a specific example, but it will be understood that the invention is not limited to this example. For this example, we assume a maximum of eight horses H1 . . . H8, and we provide an array whose X dimension is 2X the number of horses, in this case 16. The Y dimension of the array represents the length of the race. The zero position of the array is at the finish line. The different race lengths are implemented by placing the "starting gate", or the horse's starting positions, at different positions in the array for each race length. Alternatively, by initializing the Y dimension of the array, different course lengths can be selected by the players. This simulates an actual horse race which can extend over different distances.

A number of benefits are attained by using an X dimension for the track array greater than the maximum number of horses. In addition, while each of the X dimensions corresponds to a lane, referenced L0 . . . L16, only certain lanes—herein called virtual lanes—can actually be occupied by a horse. The advantages are as follows:

1. The L0 lane (the lane closest to the inner rail) is reserved for storing information about the course, so-called course markers.

2. The horses can occupy any lane from L2 upward, but each horse when occupying a particular lane at a particular course position (referenced C0 . . . C500 in this instance, the Y dimension), is also assigned by the computer, temporarily, one-half of all surrounding array positions, i.e., the adjacent lanes plus the array positions in front of and behind the occupied lane. No other horse can occupy these surrounding positions. This feature enables a horse to block following horses from passing along adjacent lanes. At the starting gate, the horses are positioned at the even-numbered lanes, L2, L4, L6, etc.

Figure 13:
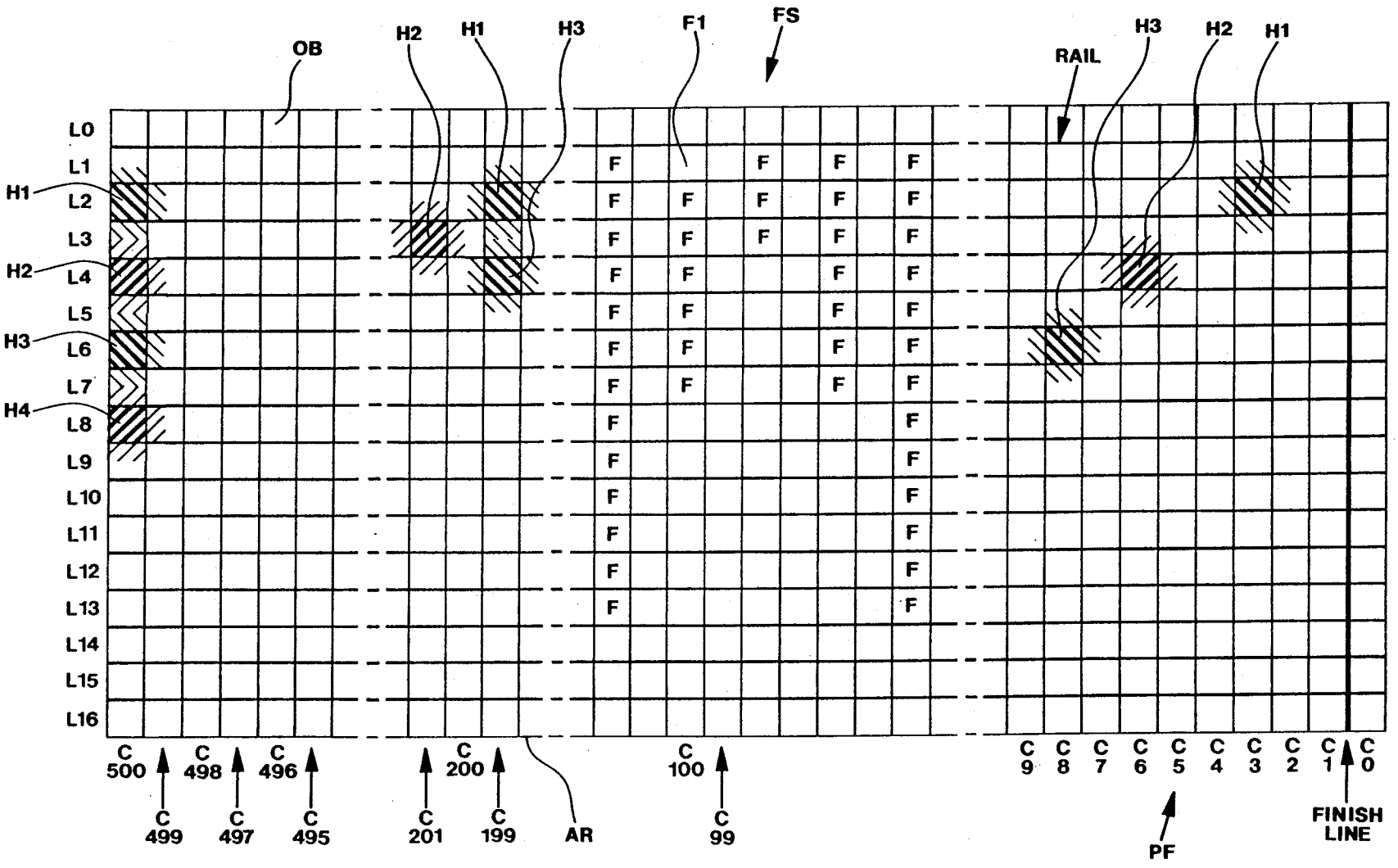
FIG. 13 illustrates one form of track array layout for use to implement the game of FIGS. 1-10.

FIG. 13 illustrates portions of the array layout, with the missing portions being essentially identical, except as will be explained later. Four horses H1, H2, H3, H4, are shown at the starting gate at course position C500. The occupied squares have fine hatching. The surrounding half-squares have course hatching.

FIG. 13 also illustrates at the center of the array AR a blocking situation for another position of horses H1, H2 and H3. In this case, horse H1 occupies lane L2 at course position C201, thus blocking lanes L1 and L3 at course position C201, and course positions C200, C201 in lane L2. The horse location is illustrated by the fine diagonal hatching. Since each horse carries with it this penumbra of adjacent sites, shown by the course hatching, horse H2 cannot pass horse H1 on the inside lane L1 because their penumbras would overlap. Horse H2 must move outward to lane L6 (at least 3 lanes away) before it will be capable of passing horses.

In a real horse race, it is an advantage for a horse to occupy an inner lane because the actual course distance around the curved turn positions is shorter than for outer lanes. How can this be simulated in a rectangular array in which the number of course locations are identical for the different lanes? In accordance with a further feature of the invention, this is accomplished by providing so-called free spaces or squares or locations F at positions in the array corresponding to the turn positions of the track. In a typical race which has a straight home stretch (also the starting position) a first curved turn, a straight back stretch, a second curved turn, and then the homestretch again, two areas of the array corresponding to the first and second turns are filled with a distribution of free spaces F to simulate the shorter distances for the inner lanes, only one of which is shown in FIG. 13. In addition, free spaces F can provide many other useful functions. In this instance, each free space F is defined to mean an automatic move by the horse to the next forward space. One suitable distribution of free spaces are shown at FS in FIG. 13. Thus, if on a move a horse ends up in space F1 in course position C100, for example, it will automatically be moved forward to location L1, C99. It will be evident from the distribution of free spaces FS that a horse occupying inner lanes closer to the rail will move faster in the forward direction than horses occupying outer lanes, because there are more free spaces F in inner lanes than in the outer lanes. It will be evident that the invention is not limited to this particular free space distribution and others can be used to carry out the equivalent function.

The game operates similarly to the patented board game, except, instead of dice, the computer automatically generates random numbers corresponding to dice values for each player during each move of a plurality of successive moves until a horse crosses the finish line. The strategical factor is implemented by assigning to each horse a predetermined reserve of energy in the form of tokens representing energy. The energy can be consumed at different rates, by using tokens corresponding to the green, white and red chips used in the patent. The joystick positions 7, 8, and 9 correspond to the fastest rate or green token, the positions 4, 5 and 6 to the medium rate or white token, and the positions 1, 2 and 3 to the slowest rate or red token. Only a limited number of energy consuming tokens are assigned to each player. Through experience, the players will learn the amount of energy consumed when the joystick is in one of its three possible positions and thus will budget this resource to use at the optimum time during the race to take advantage of this variable speed feature. The program is constructed so that when a player exhausts his high speed tokens, it will automatically default to the next available lower speed token, simulating a tiring horse. Whip chips can also be provided to each player to function in the same manner as in the board game. When the whip chip is implemented, it can be associated with the "button'on the joystick, or a designated key on the keyboard (e.g., space bar).

The manner in which the moves are implemented is an important feature of the invention. Say, during one move, horse H1 using high energy gets a high random number and horse H2 using low energy gets a low random number. If this were implemented as in the board game, horse H1 would on the display suddenly jump forward say 10 course positions or squares while horse H2 on its turn would move only 3 positions. The result would be jerky horse movements on the display. This is avoided by partitioning the total number of course positions or squares to be moved into smaller values, and implementing each move for all the horses at the smaller values. Thus, in the example given, horse H1 would first be moved 4 spaces and horse H2 1 space, then horse H1 3 spaces and horse H2 1 space and finally horse H1 the remaining 3 spaces of the move and horse H2 its remaining 1 space. In this way the display movements are smoothed out and made to appear more natural. It also has the advantage of reducing the advantage of the horse that moves first. As distinct from the board game, the computer assigns the first horse to move randomly for every move of every turn.

Figure 14:
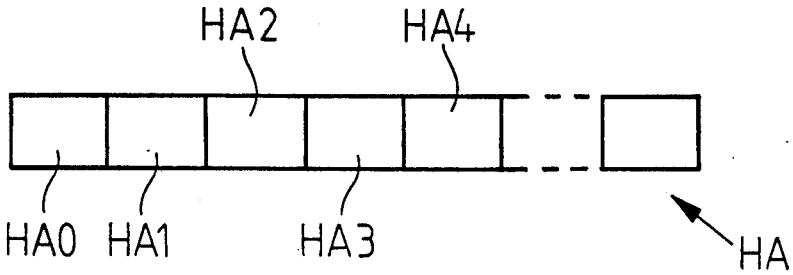
FIG. 14 is the layout for a horse array.

The energy concept lends itself to many simple but useful modifications. For example, a choice of track conditions can be made available to the players. The horses can have attributes stored in a separate array for each horse; thus some horses would be assigned a dry track attribute, others a mud track attribute. When a track condition is selected, and the horses assigned to the players, a horse running on a preferred track can be assigned more energy, or more fast rate tokens as a reward to implement the advantage such a horse would normally have. One form is illustrated in FIG. 14, which shows a one-dimensional array HA (each horse would be allocated its own array), with the following "library" type information, as an example, stored in cosecutive positions: horse identification ID at HAO; player ID at HA1; current horse location at HA2; track attribute at HA3; horse style at HA4 (explained below).

It is preferred to provide an array for all horses in the race with similar information, as a 2-dimensional array that is initialized for each race. In addition to "library" type information about each horse, it couls also contain race-time information, such as player, position on track, etc.

In another modification, say for a steeplechase game where horse obstacles are present on the track, the location of the obstacles can be marked in the reserved lane LO. As one example, to jump over an obstacle would require use of a fast rate token. Hence, when a horse approaches an obstacle, the program would test whether the reserved lane LO at the course locations involved in the move is marked for an obstacle and if so whether the player has his joystick in its 8 or straight forward, high rate position. Only then would the horse be allowed to move past the obstacle, which could appear in the array as free spaces so as soon as the horse is permitted to enter that free space it automatically moves forward to the next open space. If the joystick is not in the fast-forward position, the player would lose the move. Another simple modification is to require that the player's generated random number exceeds a certain value before the horse is allowed to move past the obstacle. The obstacle is indicated in FIG. 13 at OB at course position C495. The same concept is readily applied in an auto racing game to represent an oil slick on the track which slows up the auto as it crosses that course location.

The photofinish feature described in the patent is also readily implemented in this computer version. In this case, the first nine course positions (C1–C9) are assigned to a photofinish area PF. When a horse upon responding to a move would cross the finish line, then all other horses within the last nine course positions (array columns C1 . . . C9) can participate in a photofinish. To enhance realism, the horse displays within the photofinish area are speeded up so that they appear to cross the finish line at the same time or close behind the leader. This is implemented by increasing the movement rate of those following horses. In a preferred embodiment of the invention, the entry into the photofinish area PF by the race leader triggers a photofinish-routine, and all horses within or who would normally enter the photofinish area are moved ahead one extra space during each move of the leader. In this way, in the display, the following horses eligible to participate in a photofinish would appear to cross the finish line at the same time as the leader. The leader can only avoid a photofinish by being at least nine spaces ahead of the following horses when the leader during the next move would cross the finish line. Thus, as illustrated in FIG. 13, if horse H1 on the next move would cross the finish line, then horses H2 and H3 would be eligible to participate in a photofinish.

In a preferred embodiment, however, the leader does not have to be 9 spaces ahead to avoid the photofinish. If the following horses don't have enough of their own energy left, the leader can still win it outright. In this preferred embodiment, once a horse enters the photo zone, he will check on every move, to see if there are horses behind him, also in the photo zone. If so, he will move them all along with him. The first horse in will of course not have any other horses to move. However, any other horses who enter it afterward will be moved forward each time any horse in front of him moves forward. When his own turn comes, he can then advance one square closer to the leader(s) (moving any horses behind him as well). If he doesn't catch up before the leader crosses the finish line, he will not be in the photo.

Figure 15:
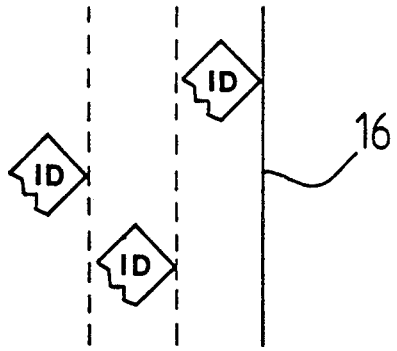
FIG. 15 illustrates one way of depicting a photofinish order.
Figure 16:
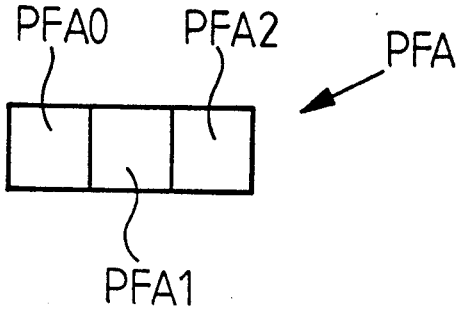
FIG. 16 shows the layout of a photofinish array.

The determination of the race outcome in a photofinish situation is similar to that described in the patent. The computer randomly selects the final horse positions from among those participating in the photofinish and displays the results on the monitor screen with the horse displays physically positioned so that the race results are obvious to the players. This can be simply implemented as shown in FIG. 15 by displaying a vertical line 16 representing the finish line, and displaying a horse's head, with its ID, touching the line as the winner, and horses' heads in spaced order to the left of the finish line to represent the place and show identifications of the other horses. A computer implementation can be a separate array PFA (shown in FIG. 16) which stores the information representing the horse ID at PFAO, the lane occupied at the finish area at PFA1, and the horse position at the race outcome at PFA2. The computer in a straight-forward manner then uses this array for locating the horses in the photofinish display. So, when the win horse is displayed at the finish line 16, the place horse would be displayed several pixels to the left of the win horse, and the show horse would be displayed several pixels to the left of the show horse, and so on. Preferably, vertical lines as shown in FIG. 16 are used to make apparent to the players the relative positions of their horses.

Figure 15A:
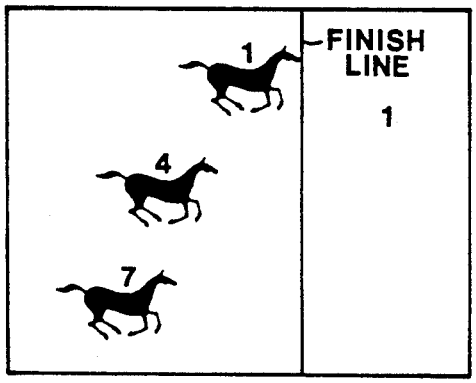
FIGS. 15A and 15B depict a modification of FIG. 15.
Figure 15B:
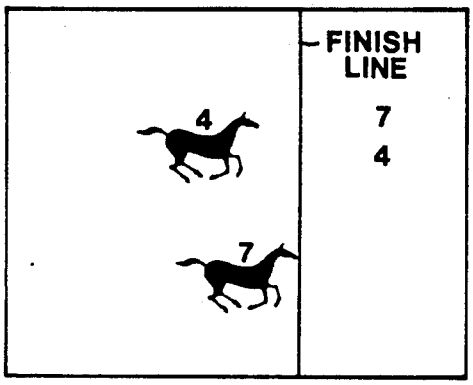

In a preferred embodiment as illustrated in FIGS. 15A and 15B, the photo finish displays the entire horse., not just the head, for all positions in the photo. The horses's ID is also shown on the right-hand side of the screen to indicate clearly the winner of the photo, or a dead heat (tie) if it occurs. Photos with more than one horse involved (and no ties at the finish line) will generate additional photos to indicate the outcome of all horses in the first photo that had not reached the finish line. In the example illustrated in FIG. 15A, the photo finish is between horses 1, 4, and 7. Horse 1 is the winner, and an additional photo (FIG. 15B) is generated. In this additional photo, horse 7 beats 4, although in the first photo 4 was ahead.

The results of any second (or other additional photos) are random though weighted against altered positions from the original photo.

Alternatively, the photo array can be implemented with 3 or 4 columns: photo position, horse #, and photo place, and dead heat indicator. There is a row for every horse for every photo. If the only photos in the race were those mentioned in FIGS. 15A and 15B, there would be 5 rows in the array—1 for each horse in the first photo, and 1 for each horse in the second photo. Photo position tells what finish order position the photo is for; photo place tells where on the photo display the horse will appear (and how far from the finish line).

It is also possible at this point in the race to implement several other features. For example, if odds have been assigned to the horses based upon their attributes, including track conditions, then the odds can be displayed on the screen when the photofinish display appears. In addition, penalties can be taken into account when determining the order of the race finish. For example, if during the race, a horse attempted to move into an area blocked by another horse, the result would be bumping, leading to a penalty. The penalty value could be stored in the array assigned to each horse. When it comes time to select horse positions in the photofinish, then the program would check the penalty location of each horse's array and thus modify the penalized horse's position accordingly, say, from win to place or from place to show, or from any position to a lower position, upgrading the other horses at the same time. Adjustments would be made using weighted random chance.

The combination of individual horse arrays for storing horse information and variable rate tokens furnishes a readily simple method for implementing horse style, that is, front runners, pace runners, and stretch runners. Thus, to implement front runner style, the computer program would require that the player with such a horse would be required to play a minimum percentage of the player's green tokens at the beginning of the race. Similarly, a player with a pace style horse would be required to distribute evenly the use of his green, white and red tokens throughout the race, and a player with a stretch style horse would be required to save a certain percentage of his or her green tokens for the homestretch. If the player did not use his tokens in the order required by his horses's style, the computer would be programmed to substitute its token selection for that of the player. Alternatively, the player could be penalized for not using his or her tokens in the manner required by the horse's style. As a further alternative, if the player did strictly abide by his or her horse's style, then s/he could be appropriately rewarded. The penalty or reward could take the form of a token redistribution, or token upgrading in value, resulting in increased energy reserve as a reward, or a decreased energy reserve as a penalty. As still a further alternative, if a player plays correctly according to style, the odds of getting "high" roll counts for greens will be maximized. If not, the odds of getting "low" roll counts will increase. (The computer will only substitute a "chip" if the player does not have any remaining of the type played.) Also, rewards or penalties can be implemented in photofinish outcomes.

The ability to reward or penalize a player by modification of his or her energy reserve, or to credit or debit in a photofinish, is an important feature that can be used to implement other race happenings. For example, different classes of horses require different styles of racing. These can be supplied in the horses attributes or its private array to modify moves.

The winning time of the race cannot easily be determined by clock time, for comparison with previous or subsequent races. A more accurate scheme for comparing performance is by token usage as a function of race distance. For example, by allocating a value of five to the green tokens, three to the white tokens, and one to the red tokens, then each player, depending upon course distance, would be allocated at the race beginning a predetermined amount of energy corresponding to a certain distribution of the green, white and red tokens. In such event, the horses' performance can be rated by the amount of energy consumed to win a race of a particular distance, and translated by the computer into a realistic time in minutes and seconds that can be displayed on the screen.

FIGS. 1 to 10 illustrate one form of program structure suitable for implementing a horse race in accordance with the invention. These figures use the dataflow oriented approach and illustrate the information flow as well as a decomposition of the overall program into modules or subroutines to carry out the functions indicated, which are described in great detail. The actual coding is straight forward, given the functions to be performed and their sequence. Those skilled in the art will have no problem in carrying out the invention using the accompanying drawings, the principles described, and the detailed description given below.

What now follows is a description of FIGS. 1 to 10 and what each of the modules represent, what functions they perform, and the conditions under which they are executed. To read the drawings, start at the top and read top to bottom, left to right. The notation used in the boxes is as follows:

1) Box without notation

Process is always performed one time.

2) Box with "o" in upper right corner

Process is performed conditionally. Only one of these boxes will be performed.

3) Box with "*" in upper right corner

Process is performed as an iteration, either a specified number of times, or until a specified condition is met. If the condition is already true, the process will be not performed.

FIG. 1 Text

10'

This box is the figurehead for the entire program. All the processing is described in the subsequent boxes.

20

Figure 1:
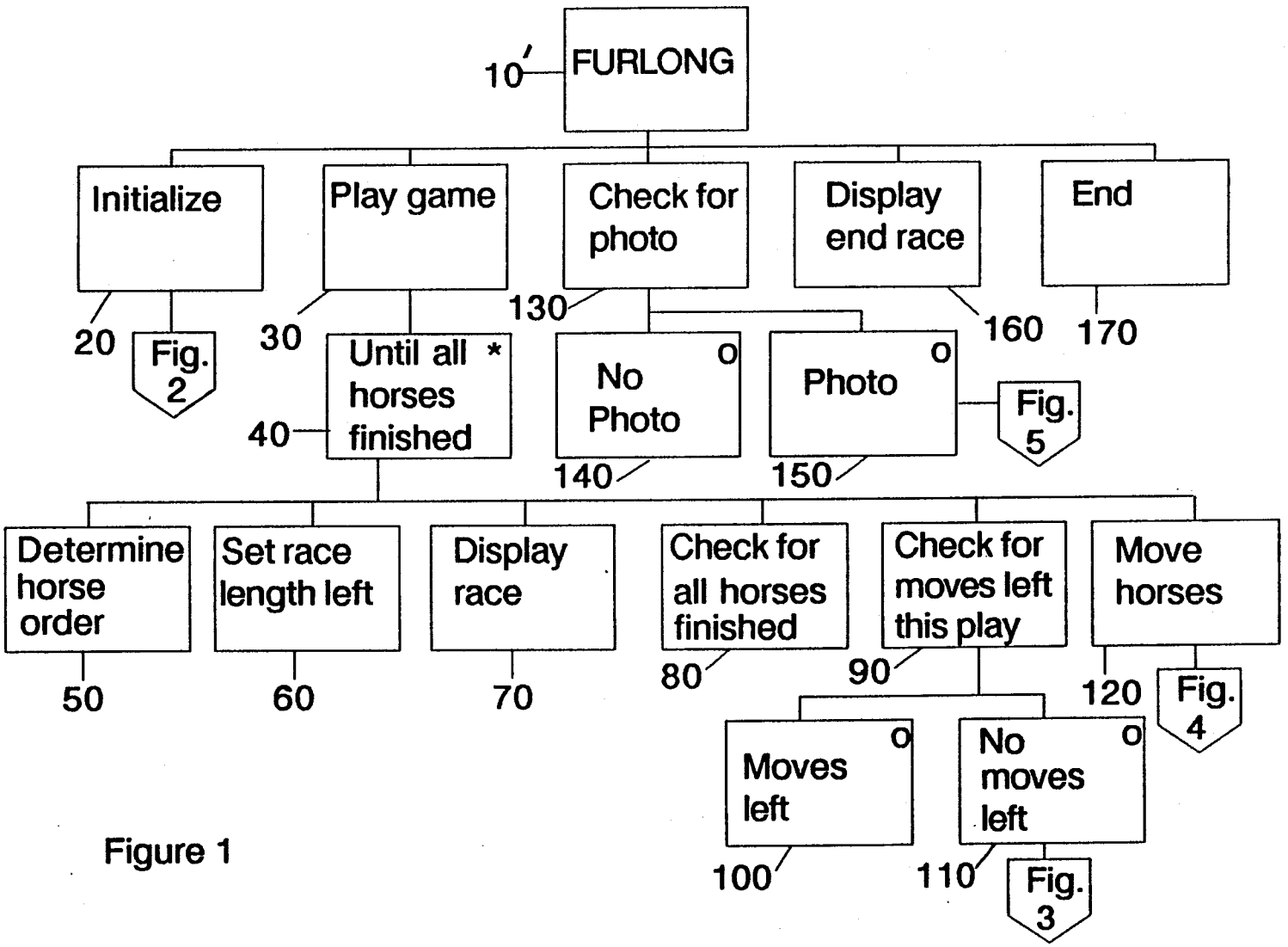
FIGS. 1-10 are the program structure of one form of racing game according to the invention.
Figure 2:
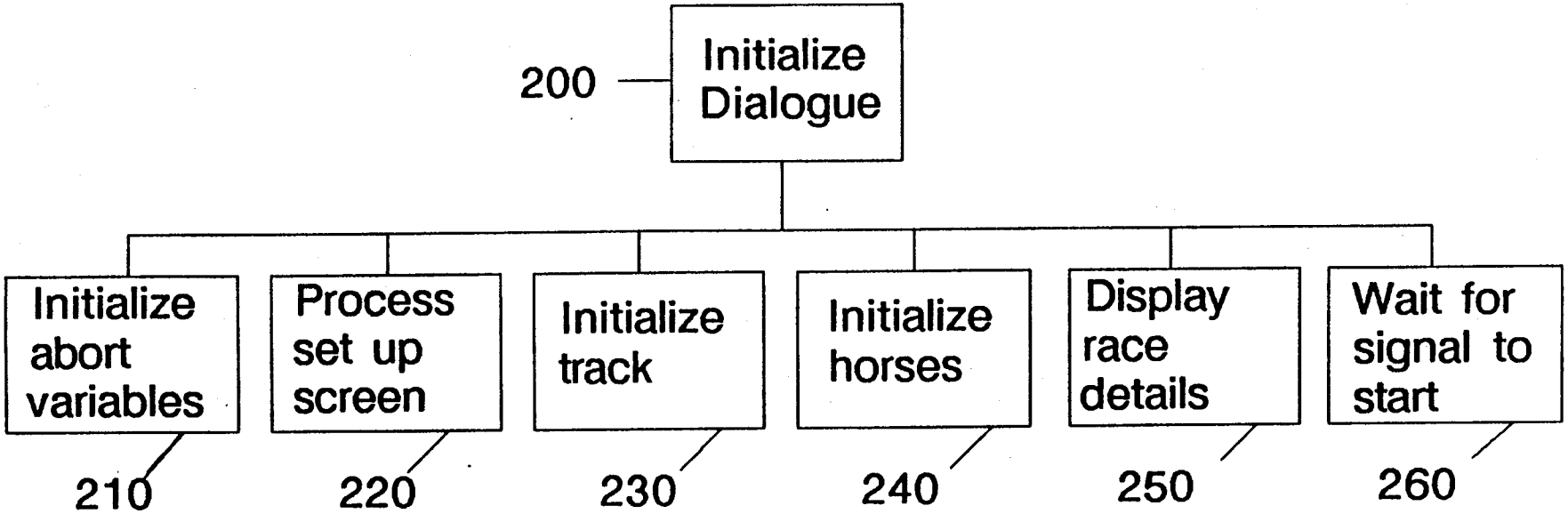

Initialize the game variables and arrays as follows:

1) Initialize the graphics processing.
2) Initialize and present a title page welcome screen.
3) Initialize the graphics images.
4) Initialize the dialogue to accept input (see FIG. 2)

Set control variables to default values:

1) horses positioned in the start gate
2) horses are in post position order
3) race is not done
4) no horses have moves left to be made on this play (signifies new play)
5) rail post to be displayed
6) gate to be displayed
7) delay for starter effect
8) set race length left
9) display horses breaking out of the gate Race has begun.

30

Figurehead box for the iterative race process. The race is made up of a number of plays, during which all horses appear to be running simultaneously, but in fact they move one at a time, one third of a horse length at a time. In a single play, each horse can get a move count from 2 to 15, each unit counting as a third of a length.

40

Perform all processing below this box until the race is done (all horses have crossed the finish line) or the race is aborted.

50

Sort horses into horse order array with leading horse first.

60

Set race length left by using position of leading horse.

70

Check to see if horses have run all the way across the screen by subtracting the race length left from the starting position, and comparing it to the width of the displayable track (currently 20 lengths). (This is done to simulate the effect of the viewing window following the running horses. Until the horses reach the far right side of the screen, the rail, gate and posts do not move. Once the lead horse reaches the right side, he runs in place, and the rail, gate and posts begin to scroll to the left. This continues, with horses changing positions relative to whichever horse is in the lead, until the finish post appears. Then, the rail and post freeze again, and the horses run off the screen to the right as they cross the finish line.)

Display the gate, rail, rail-posts, and horses accordingly. Display the overview window on the bottom section of the screen, showing all the horses in relation to each other by using the post position numbers in the display. (This is to allow a wider viewing field when the horses get separated. Any horse more than 20 lengths behind the leader will not appear on the graphic display.) Display the numbers of the four leading horses on the right edge of the screen, if the leader has completed one fourth of the race.

80

Test to see if all horses are finished, set a completed flag if they are.

Test for keyboard program abort key entered, set an abort flag if entered.

90

Check for moves left this play.

100

If there are still moves left this play, do nothing here.

100

Figure 3:
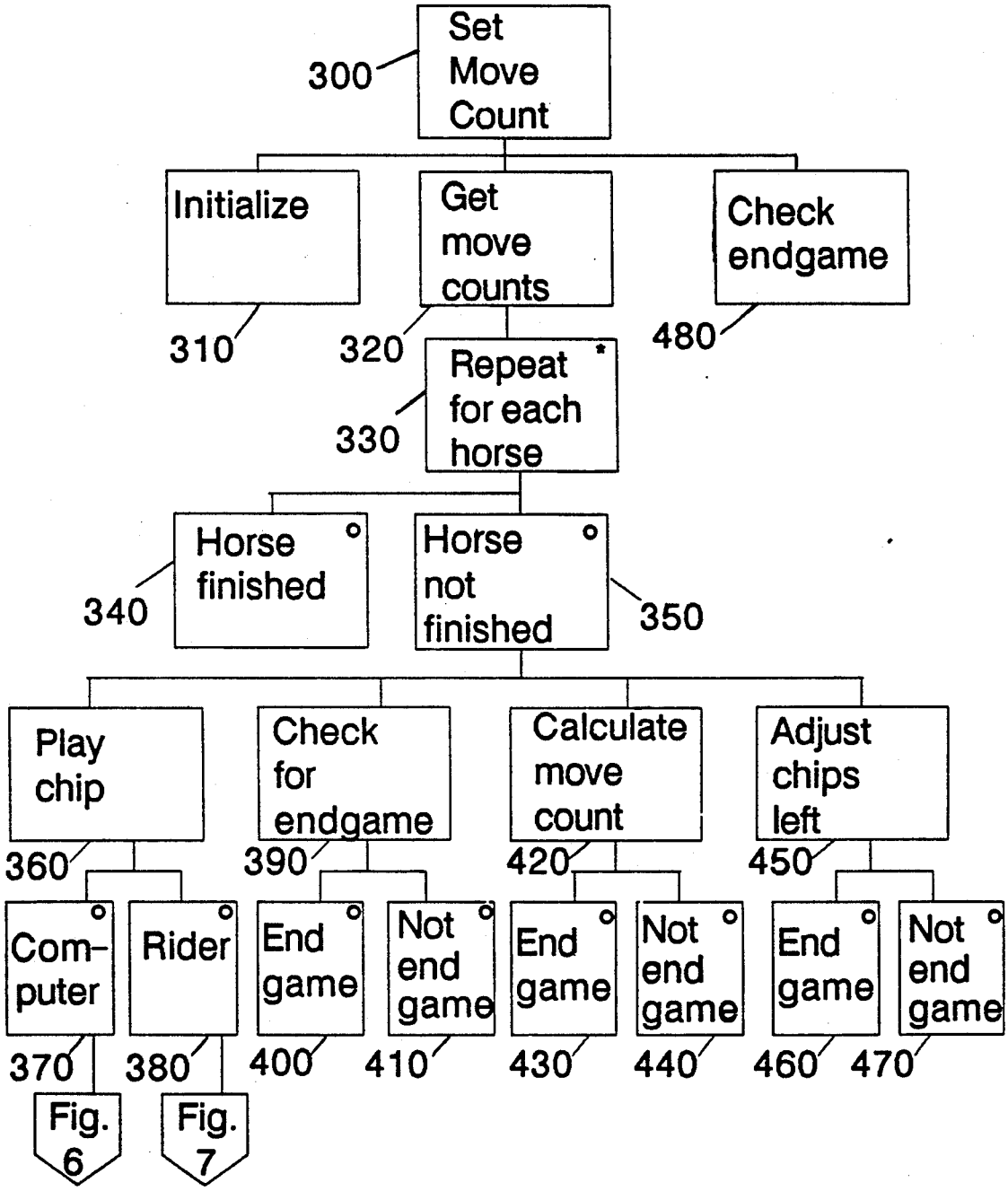

If there are no moves left this play, set the move counts for a new play (see FIG. 3).

120

Figure 4:
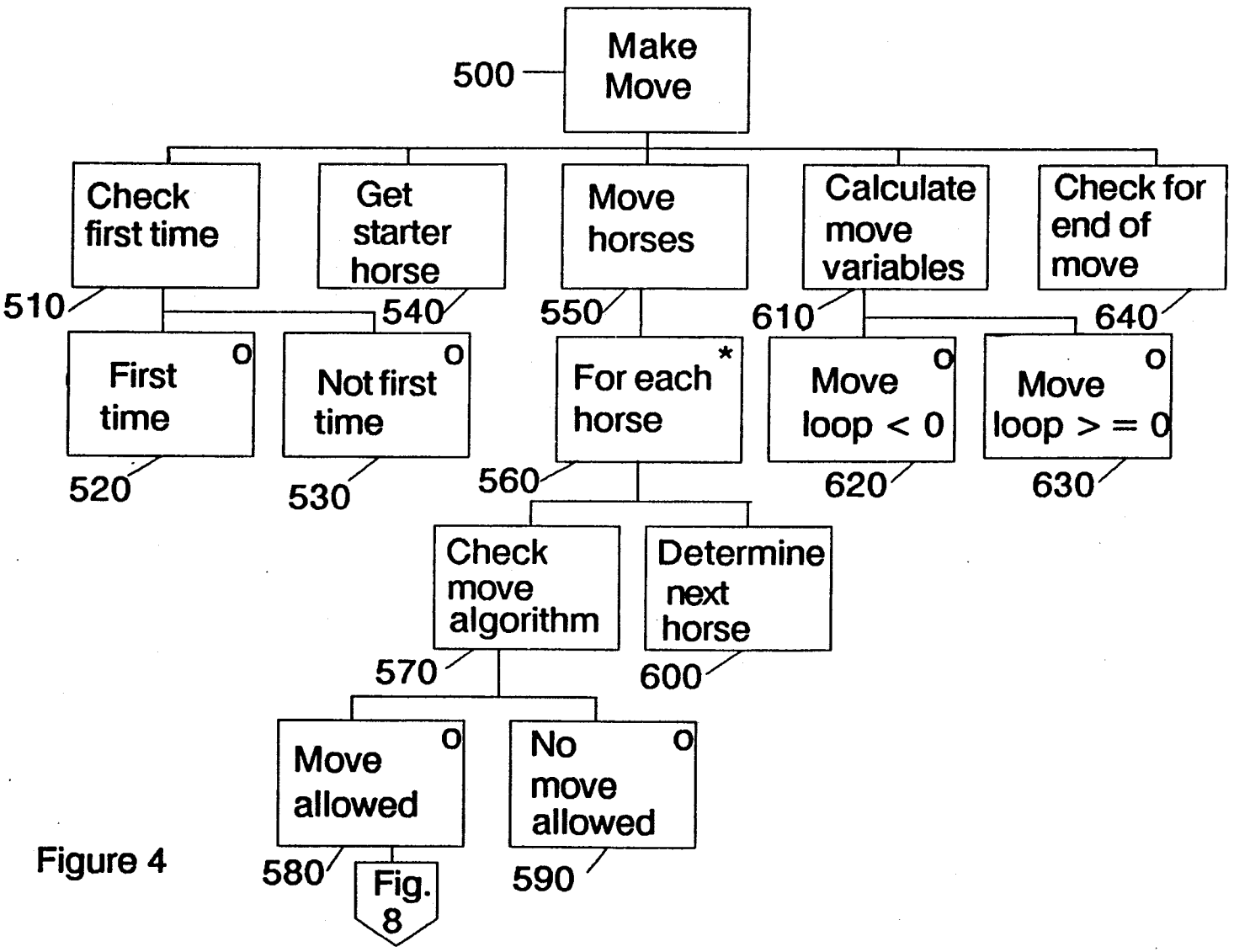
Figure 5:
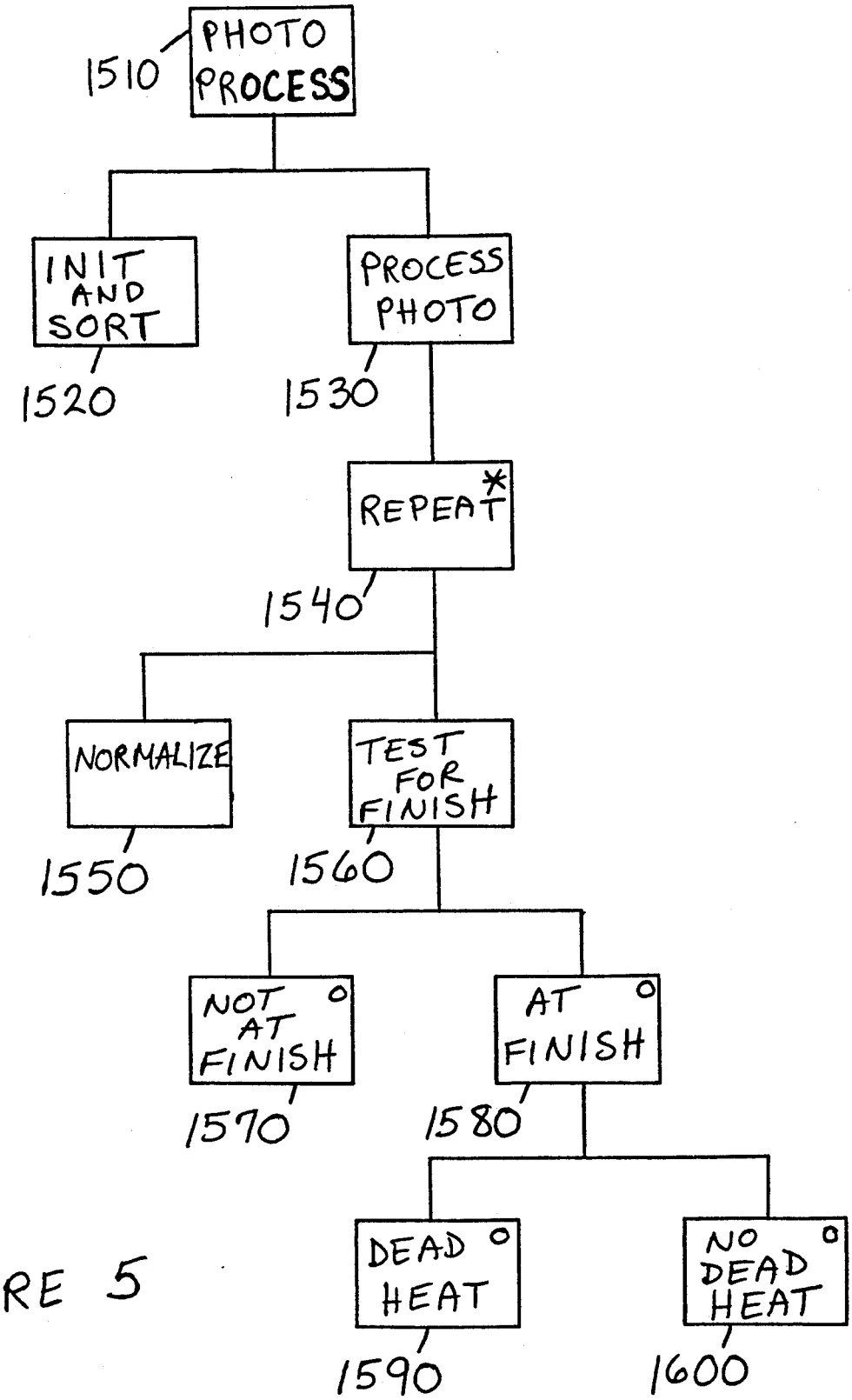

Make a move (see FIG. 4). Note: After this is performed, return to Box 40, and repeat until that condition is met before advancing to Box 130.

130

Test for photo flag set.

140

If no photo flags are set, do nothing here.

150

If there are any photo flags set, perform photo finish processing. Display photos according to the photo array, one by one, until all are displayed.

160

Sort horses into horse order array by using the finish positions, with the winner first. Display the end of race results screen.

Delay for readability of final screen. Redisplay set up screen. If play again is selected, reinitialize and return to Box 10. Otherwise, return to DOS. Game is over.

FIG. 2 Text

200

Display the graphic race setup screen with default variables.

210

Initialize the "abort key hit" flag to no. Initialize the "check for abort" flag to yes. This is required if there is no player using the keyboard for controlling a horse.

220

Get race variables from the setup screen:

1) Number of horses in the race
2) Race length

3) Number of players controlling horses (riders)
4) Types of controls being used (joysticks, keyboard)
5) Race style
6) Track conditions
7) Horse styles

230

Initialize the track array:

1) Mark the inner rail as straight, left curve, double curve, and right curve, for the dimensions of the track.

2) Mark the furlong markers (8) on the inner rail where they should appear on the track.

3) Zero out all other track positions.

4) Populate the free squares on the track, to simulate the curves. The inner lanes have the most free squares, the outer lanes the fewest. A horse landing on a free square gets to move ahead one square. This makes the inner lanes shorter and the outer lanes longer, similar to the advantage on a real oval track.

240

Initialize the horse array, for each horse:

1) Set default values on all horses for position on track (kept by "lane" and "square" variables)

2) Set controller to "computer"

3) Set token (the chip used to indicate speed) played to "fast"

4) Set finish place, lengths behind leader, tokens left, energy left, move count, number of times blocked in all directions, whips left, whip played, photo position, photo place to zero 5) Set direction played to "straight"

6) Set style to "pace"

7) Set controller to "right" (for joysticks)

8) Initialize photo list to zero Set end game flag to not end game. Calculate number of tokens using formula: (Number of furlongs * 3 (tokens per furlong) * 3 (types of tokens)) +3 (extra energy) Set leader position to start of race.

Initialize for player controlled horses:

1) select unique post position: Randomly select post position. Set post position unique flag to false. While the flag is false, Check the controller of the horse for that post position If it is equal to zero (indicates computer control), then set the post position unique flag to true. Else, randomly select another post position.

2) Set the player control and controller variables.

3) Set the post position in the player array. (This keeps track of all information for each player collected at the dialogue screen.) Set the correct number of tokens of each color (speed) for each horse. Randomly set style for each computer controlled horse, unless the horses are chosen from a library of preselected horses which already have styles associated with them. In this case, set the appropriate style for the computer horses accordingly. Modify the token assignments to increase the energy of the outer horses. This only partially makes up for the outer lane track disadvantage: Horses 1 and 2 are not changed. Horses 3 and 4 upgrade one slow token to one medium token. Horses 5 and 6 upgrade one slow token to one fast token. Horses 7 and 8 upgrade one slow token for one fast token and one slow token for one medium token. Set photo finish to false. Set number of horses in photo and number of horses finished to zeroes.

250

Display graphic screen of race details, including styles of all horses and post positions.

260

Delay until keyboard key is hit to start race.

FIG. 3 Text

300

Figurehead box for set move count process. This will set new move counts for all horses in the race.

310

Initialize move algorithm loop counter to zero. (This loop counter will indicate when this play is done, and it is time for a new move count to be set.) Initialize high move count to zero.

320

Figurehead box for the iterative process of getting move counts for each horse.

330

All processing under this box is performed once for each horse in the race, starting with horse number one.

340

If horse has finished the race (occupied square or course position=zero location on track array), then do nothing here.

350

If the horse has not finished the race (square>0), then processing continues under this box.

360

Check how this horse is controlled (computer or player).

Figure 6:
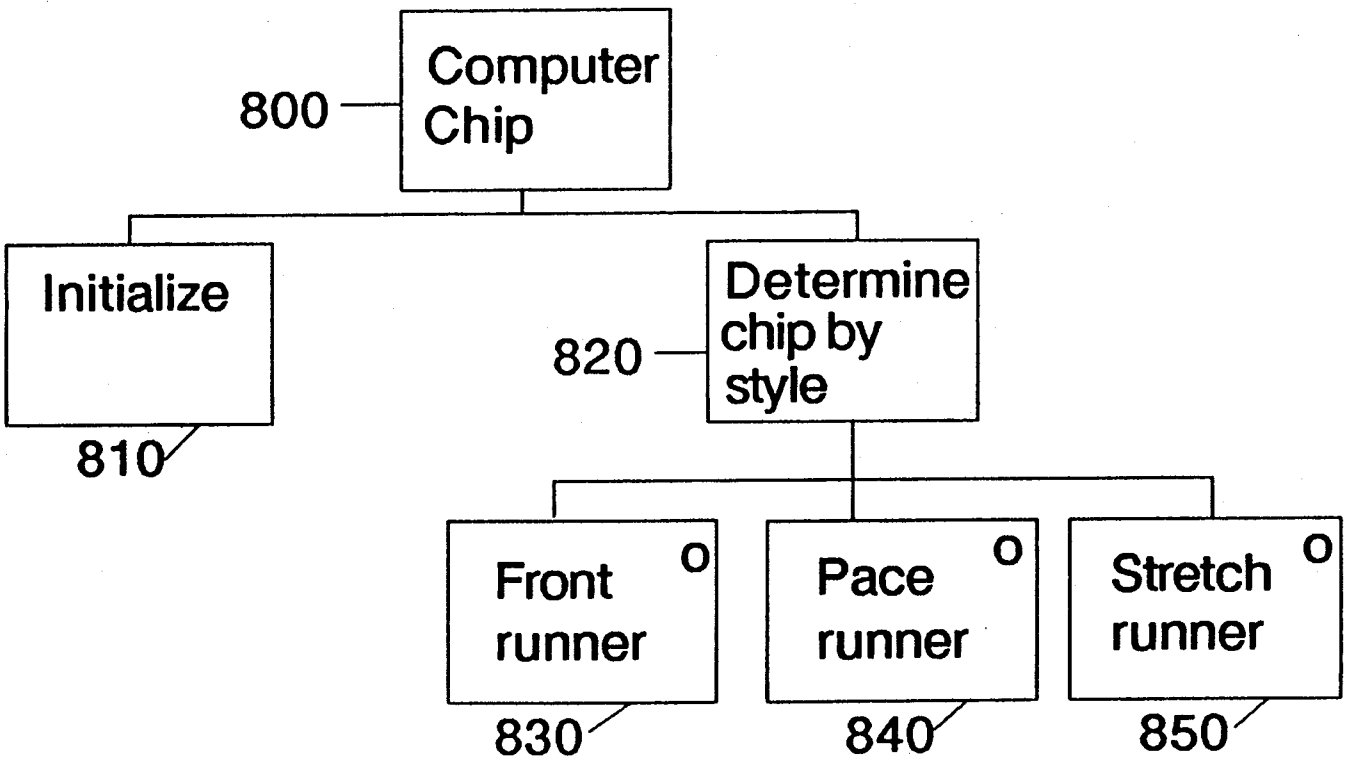

If the horse is controlled by the computer, get the token played from the computer token algorithm (see FIG. 6).

380

Figure 7:
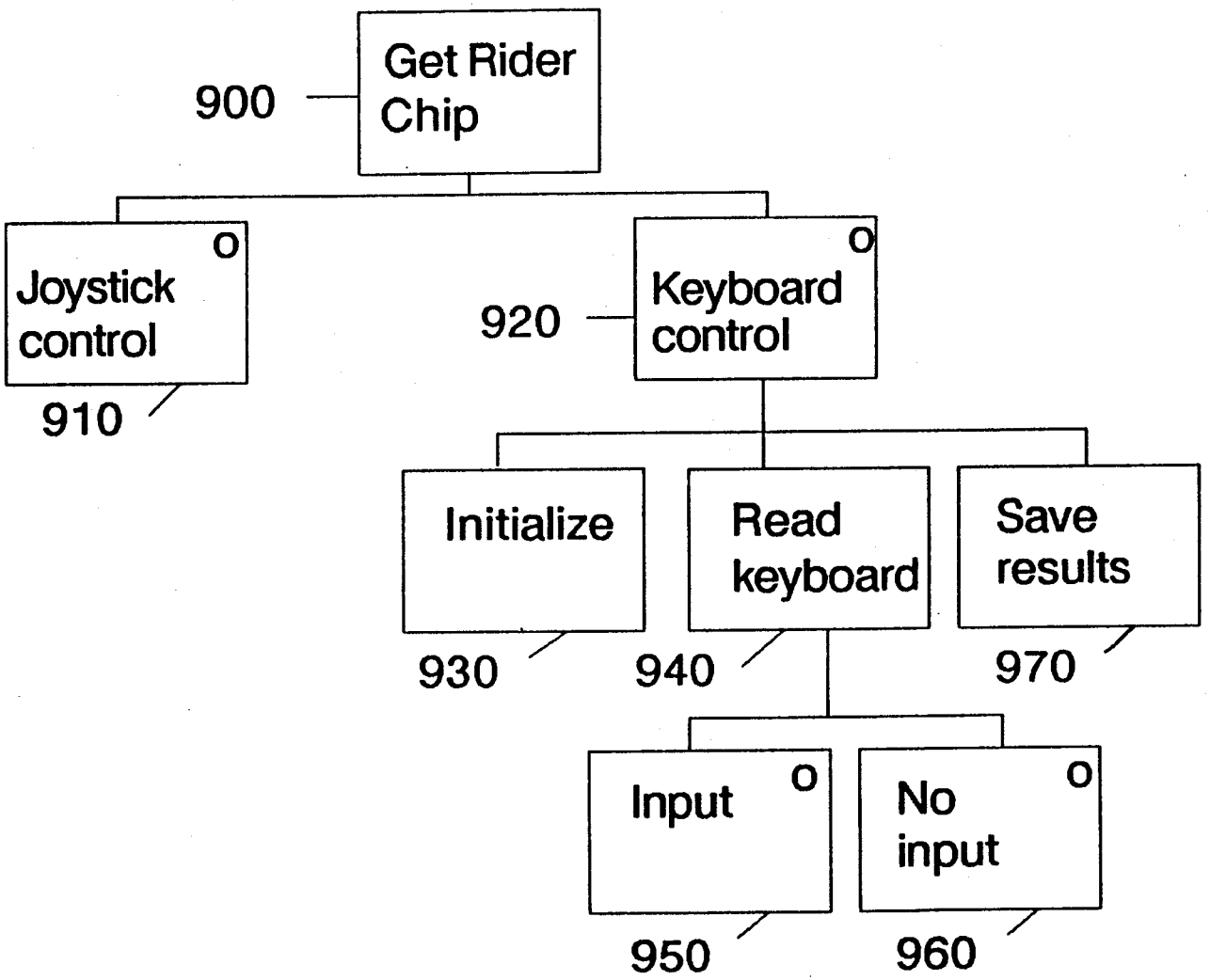

If the horse is controlled by a player, get the token played from the player token algorithm (see FIG. 7).

390

Check to see if end game is in progress. (End game is put in progress when all horses have run out of tokens, which will happen simultaneously for all horses still running, and not all horses have crossed the finish line. In end game, every speed token played is equivalent to medium speed. This stays in effect until the last horse crosses the finish line. Riders who still have whips available may use them in end game, and whips will respond or not, as during regular play. Note: end game is virtually transparent to the player(s). It is an internal routine used to guarantee that all horses will have enough energy to finish the race.)

400

If end game is in progress, do nothing here.

410

If end game is not in progress, check to see if the token played is available by checking the token counts for this horse. If the token played is not available (token count is zero for that speed), then use the lowest speed of the two alternate tokens. If that is not available, use the remaining token. (Token played is set to a numeric value: 1 for slow, 2 for medium, 3 for fast. Later this same value is used as a loop counter in the algorithm for randomly generating the move count number.)

420

Initialize the move count to zero. Check to see if end game is in progress (detailed in boxes 430 and 440) and set move count. After move count is set, check to see if a whip has been used for this play. If a whip has been used, check to see if there is a response. If there is a response, then add a random number from 2 to 4 inclusive to the move count. Compare the move count to the high move count. If it is greater, set the high move count equal to this move count. Store the move count for this horse in the horse array.

430

If end game is in progress, then set move count to the sum of two random numbers from 2 to 5 inclusive.

440

If end game is not in progress, then set the move count to the sum of x random number(s) from 2 to 5 inclusive, where x is the numerical value for the token played (1=slow, 2=medium, 3=fast).

450

Check to see if end game is in progress, to see whether or not to adjust the remaining token count.

460

If end game is in progress, do nothing here.

470

If end game is not in progress, then subtract one from the horse's token count for the token played.

480

Subtract one from total tokens left counter. If tokens left counter is now zero, then set tokens left counter to 3 and set the end game indicator to true. End game is now in progress for all subsequent plays.

FIG. 4 Text

500

Figurehead box for make one move processing. This routine will check each horse, and if the horse has a move, it will move the horse one square.

510

Check to see if this is the first iteration of this play (this "dice roll"), by testing move loop equal to zero.

520

If move loop is equal to zero, this is the first time through for this turn. Initialize the algorithm variables to perform the move processing:

Initialize move step to (high move count +3)/5Initialize start step to (move step * 4) Initialize move loop to −4 Initialize move inner loop to the value in start step

530

If move loop is not equal to zero, this is not the first time through (not a new move count, but continual play on a prior move count); do nothing here.

540

Randomly select the horse to start the move with.

550

Figurehead box for the actual move processing.

560

All processing under this box is performed once for each horse in the race.

570

Check to see if the horse can move in this turn by comparing the horse's move count to the move inner loop.

580

Figure 8:
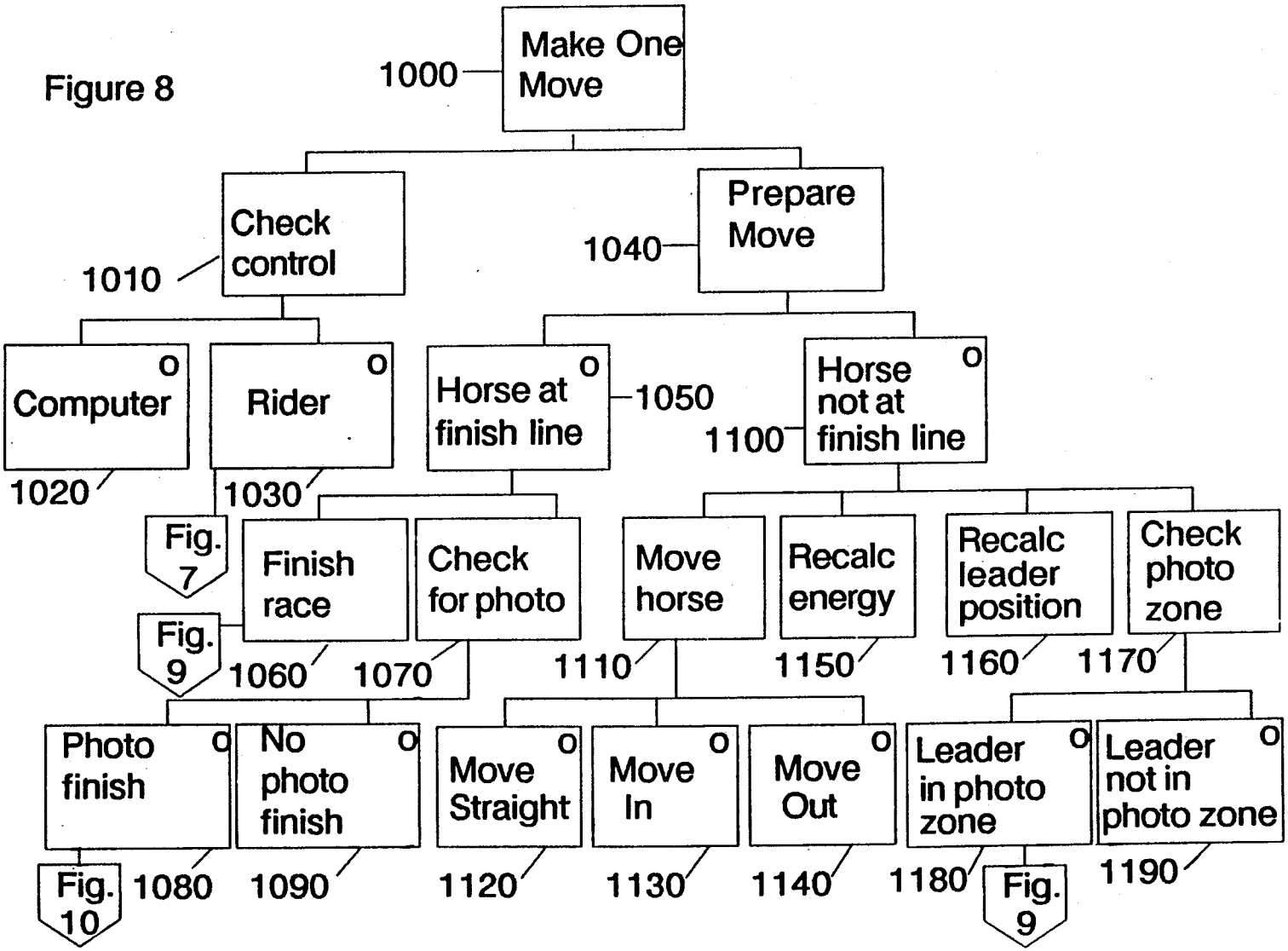

If the horse's move count is greater than the move inner loop, then the horse can move in this turn (see FIG. 8). After the move, subtract 1 from the horse's move count.

590

If the horse's move count is not greater than the move inner loop, then the horse can not move in this turn; do nothing here.

600

Determine which horse to move next by adding one to the horse number in play. If the new horse number is greater than the number of horses in the race, then set the new horse number to one (this forces a wrap around).

610

Adjust move algorithm variable:

Add the value in move loop to move inner loop. (This will decrement move inner loop.) Check to see if move inner loop is below zero for further move algorithm adjustments.

620

If move inner loop is less than zero, then adjust move algorithm variables: Add 1 to move loop Subtract the value in move step from start step (decrementing start step) Set move inner loop to the new value in start step

630

If move inner loop is not less than zero, then no further adjustments need to be made; do nothing here.

640

Check to see if this move has been completed. If move loop is equal to zero, then set flag to indicate this move is complete and it is time to set a new move count. Otherwise, set flag to indicate this move still has turns left.

FIG. 6 Text

800

Figurehead box for computer played token routine.

810

Initialize weight variable to random number from 0 to 99 inclusive.

820

Check the computer horses racing style.

830

If the horse is a front runner then set the token by the following algorithm: If the random weight variable is less than 45, play a green token. If the random weight variable is between 45 and 74 inclusive, play a white token. If the random weight variable is 75 or higher, play a red token. (This causes the front runner to play more green tokens early in the game.)

840

If the horse is an off the pace runner then set the token by the following algorithm: If the random weight variable is less than 33, play a green token. If the random weight variable is between 33 and 66 inclusive, play a white token. If the random weight variable is 67 or higher, play a red token. (This evenly distributes all color tokens, giving the horse a more steady pace.)

850

If the horse is a stretch runner then set the token by the following algorithm: If the random weight variable is less than 25, play a green token. If the random weight variable is between 25 and 54 inclusive, play a white token. If the random weight variable is 55 or higher, play a red token. (This causes the horse to use the reds early and save the greens for later in the race.)

Note: When a horse plays a token that is no longer available to him, the token is altered according to the algorithm described in FIG. 3, Box 410.

FIG. 7 Text

900

Check to see how the rider is controlling the horse (joystick or keyboard).

910

If the horse is controlled by the joystick:

Read the joystick port for current joystick positions. Set the x and y axis variables to the registers corresponding to either left or right joystick control (for two joystick setup). Interpret the results as follows: If the stick is forward, the token is green. If the stick is centered horizontally, the token is white. If the stick is back, the token is red.

If the stick is to the left, the direction is moving in. If the stick is centered vertically, the direction is moving straight. If the stick is to the right, the direction is moving out.

920

Figurehead box for processing if horse is controlled by keyboard.

930

Set default token value to white. Set default direction value to moving straight.

940

Read the keyboard to see if anything has been entered.

950

If input has been entered on the keyboard: If a 7, 8 or 9 was entered, the token is green. If a 4, 5 or 6 was entered, the token is white. If a 1, 2 or 3 was entered, the token is red.

If a 1, 4 or 7 was entered, the direction is moving in. If a 2, 5 or 8 was entered, the direction is moving straight. If a 3, 6 or 9 was entered, the direction is moving out.

If anything else was entered, and the horse is not in the starting gate, then use the last token and direction played. (Otherwise use the default values.)

960

If nothing was entered, and the horse is not in the starting gate, then use the last token and direction played. (Otherwise use the default values.)

970

Save the token and direction played in last token and direction.

FIG. 8 Text

1000

Figurehead box for the make one move processing. This is performed to move one horse one move.

1010

Check to see how the horse is controlled.

1020

If the horse is controlled by the computer, then use the following algorithm to determine the direction:

1) Set the direction to the default of straight.

2) Check to see if the horse is in the gate or the backstretch (last 140 spaces). If the horse is not in the gate or the backstretch, then move the outer horses in as follows: If the horse number is greater than 4, and the move loop is equal to $-4$ (first turn of a new move), and the horse is in the first furlong (first 73 spaces) or the last furlong of the backstretch (spaces 274 to 348), then if ((horse $\#-5$)* 2)+3 is less than the lane the horse is currently in, then set the direction to moving in.

(This will move horse 5,6,7,8 into lanes 3,5,7,9 respectively, moving them in on the first count of each turn until they have reached their designated lanes or have moved out of the furlongs before each turn. This enables the computer controlled horses to "save ground" by moving in before the turns.)

3) If the horse is in the lead, and not on the rail, and it is the first or third turn of a new move (Move loop$=-4$ or $-2$), and the inside square is available, then set direction to moving in.

4) If the direction is set to straight, check to see if the square in front of the horse is available. Also check to see if there is a horse blocking on the inside (one lane over). If either the square in front or on the inside lane is not available, then set the direction to moving out.

5) If the direction is set to straight, then check to see if there is a horse blocking on the outside (one lane over). If there is a horse blocking on the outside, then if the horse is at least three lanes away from the rail, then set the direction to moving in, else set the direction to moving out.

1030

If the horse is controlled by a player: If the horse is in the gate (starting position), then set the direction to moving straight, else get the direction from the player token algorithm (see FIG. 7).

1040

Figurehead box for the move processing.

1050

Figurehead box for if the horse is at the finish line (square <2).

1060

Move the horse across the finish line by setting the Track array and the horse array square values to zero. Also reduce the horse's move count to zero. Set the leader position to finished. Set the photo position for this horse in case there is a photo, for the next available finish position (first, second, third, etc.). Set the photo flag to true for this horse. Perform the photo zone move processing algorithm (see FIG. 9).

1070

Check to see if there is a photo finish (photo flag is true).

1080

Figure 10:
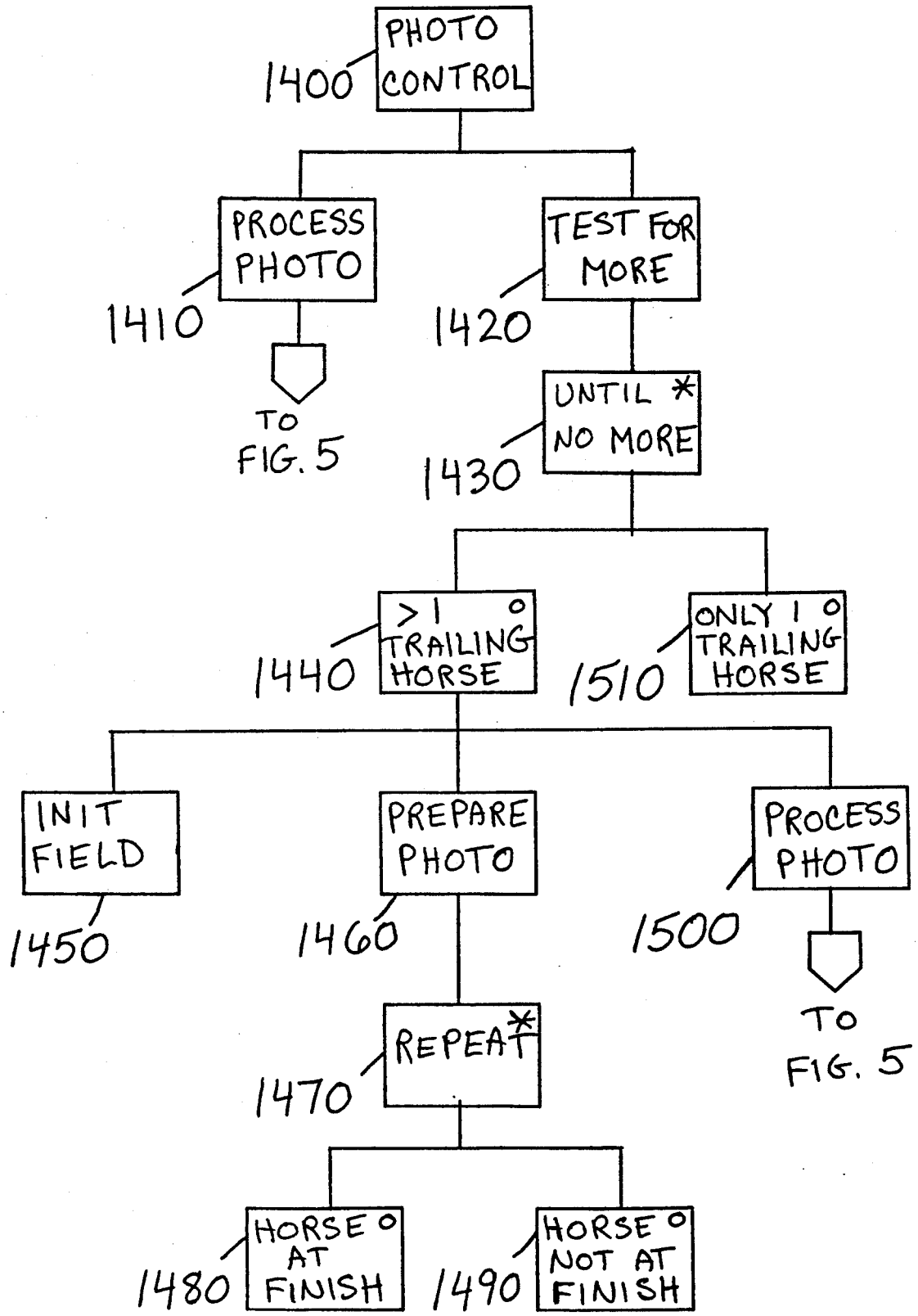

If there is a photo finish, perform the photo result algorithm (see FIG. 10). Add the number of horses in the photo to the number of horses finished (to arrive at an updated count of horses finished). Set the photo flag to false.

1090

If there is no photo finish, then add one to the number of horses finished. Set the horse's finish place to the number of horses finished. Set the horse's photo position and photo place to zero. Set the photo flag for this horse to false.

1100

Figurehead box for if the horse is not at the finish line.

1110

Check to see which direction is played.

1120

Algorithm for moving straight:

Set square available flag to default value of true. Set free square ahead flag to default value of false. Set free square found flag to default value of false. Set target square to current horse position minus one. Set square ahead to current horse position minus two. If horse is not at the finish line (square ahead > zero) then check to see if the square is available (no need to check when the horse is at the finish line, because the finish line is always available when moving straight):

1) Check the square ahead in the lane inside the horse, the lane the horse is in, and the lane outside the horse, to see if any of them have a horse already there. If there is a horse there, then set the square available flag to false. (This forces a cushion of space around each horse.)

2) Check the square ahead in the lane the horse is in to see if it is a free square (−99). If it is a free square, set the free square ahead flag to true, then test to see if the square in front of that is available. If it is not available (contains a value greater than zero), then set the square available flag to false.

3) If there is a free square ahead, then check the square in front of the target square, in the lane outside the horse, to see if it is available (this makes sure there is a cushion in front and on both sides of the horse, not counting free squares as cushion).

4) If the square is available, then test for a free square in the target square. If the target square (in the lane the horse is in) is a free square, then set the free square found flag to true. Also check to see if the square in front of the square ahead is available in the lane inside the horse, the lane the horse is in, and the lane outside the horse. If there are horses in any of these squares, then set the square available flag to false.

5) If the square is available, then if the free square found flag is true, then set the target square equal to the square ahead. Now set the track array (lane, square) to the number of the horse, and set the old lane and square position on the track array to zero. Set the square in the horse array to the target square.

6) If the square is not available, then add one to the counter of horse blocked straight.

1130

Algorithm for moving in:

Set square available flag to default value of true. Set free square found flag to default value of false. Set target lane to current horse lane minus one (same square). Set lane inside to current horse lane minus two. If horse is against the rail (lane inside <1) then set square available flag to false (can't move in!). Else, check to see if the square is available:

1) Check the square behind in the lane inside the horse, the adjacent square in the lane inside the horse, and the square ahead in the lane inside the horse, to see if any of them have a horse already there. If there is a horse there, then set the square available flag to false.. (This forces a cushion of space around each horse.)

2) Check the square behind in the lane inside the horse to see if it is a free square (−99). If it is a free square, then test to see if the square behind that is empty. If it is not empty (contains a value greater than zero), then set the square available flag to false.

3) Check the square in front in the lane inside the horse. If there is a free square (−99), then check the square in front of that square, in the lane inside the horse, to see if it is empty (this makes sure there is a cushion in front and on both sides of the horse, not counting free squares as cushion). If it is not empty (contains a value greater than zero) then set square available flag to false.

4) If the square is available, then test for a free square in the target square. If the target square (in the lane inside the horse) is a free square, then set the free square found flag to true. Also check to see if the square in front of the square ahead is available two lanes inside the horse, one lane inside the horse, and the lane the horse is in. If there are horses in any of these squares, then set the square available flag to false.

5) If the square is available, then if the free square found flag is true, then set the target square equal to the square ahead in the lane inside the horse. Now set the track array (lane, square) to the number of the horse, and set the old lane and square position on the track array to zero. Set the lane and square in the horse array to the target lane and square.

6) If the square is not available, then add one to the counter of horse blocked in.

1140

Algorithm for moving out:

Set square available flag to default value of true. Set free square ahead flag to default value of false. Set target lane to current horse lane plus one (same square). Set lane outside to current horse lane plus two. If horse is against the outside rail (lane outside >maximum number of lanes) then set square available flag to false (can't move out!). Else, check to see if the square is available:

1) Check the square behind in the lane outside the horse, the adjacent square in the lane outside the horse, and the square ahead in the lane outside the horse, to see if any of them have a horse already there. If there is a horse there, then set the square available flag to false. (This forces a cushion of space around each horse.)

2) Check the square behind in the lane outside the horse to see if it is a free square (−99). If it is a free square, then test to see if the square behind that is empty. If it is not empty (contains a value greater than zero), then set the square available flag to false.

3) Check the square in front in the lane outside the horse. If there is a free square (−99), then check the square in front of that square, in the lane outside the horse, to see if it is empty (this makes sure there is a cushion in front and on both sides of the horse, not counting free squares as cushion). If it is not empty (contains a value greater than zero) then set square available flag to false.

4) If the square is available, then test for a free square in the square ahead of the target square. (The way the track is set up, it is impossible to move out into a free square. The free squares are all lined up, and extend across the lanes in the same square. Some free squares extend across only three lanes, some extend across all but the last three lanes.) If it is a free square, then check to see if the square in front of the square ahead is available two lanes outside the horse. If there is a horse there, then set the square available flag to false.

5) If the square is available, set the track array (target lane, square) to the number of the horse, and set the old lane and square position on the track array to zero. Set the lane in the horse array to the target lane.

6) If the square is not available, then add one to the counter of horse blocked out.

1150

Recalculate the energy left for the horse by the following algorithm:

| |
|---|
| Energy = (number of red tokens left) + (number of white tokens left * 2) + (number of green tokens left *3) |

1160

If the horse's square is less than the saved leader square, then set the leader square to the horse's square (new leader position).

1170

Check to see if the horse is in the photo zone.

1180

Figure 9:
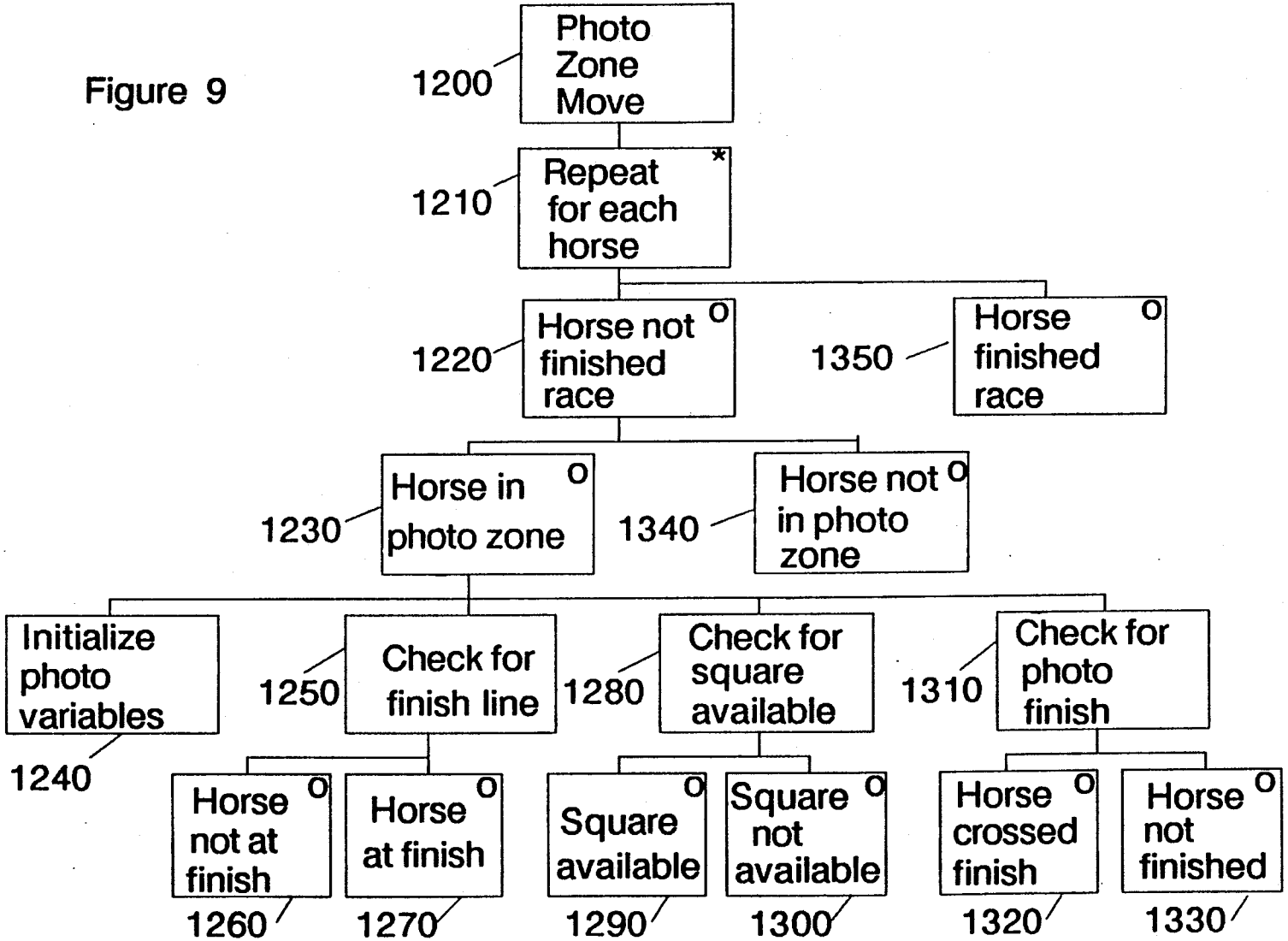

If the leader position is less than 9 (less than nine squares from the finish), then check to see if there will be a photo zone move (see FIG. 9).

1190

If the leader position is greater or equal to 9, then do nothing here.

Figure 9 Text

1200

Figurehead box for the photo zone move algorithm. This routine helps create the photo finishes. When horses are very close to the finish line together, then this routine makes them cross the line at the same time, rather than allowing a horse to win due to getting to move first on that turn. It also makes the finishes more exciting.

1210

Set up a loop to check each horse in the race for potential photo zone move. (All subsequent processing is repeated for each horse in the race.)

1220

If the horse is not yet finished the race (square>0), then check to see if he is in the photo zone.

1230

If the horse is in the photo zone (square>10), but further from the finish than the horse who's move turn it currently is (prior to the photo zone move), then prepare to make a photo zone move.

1240

Set square available flag to default value of true. Set target square to the horse's square−1. Set square ahead to the horse's square−2.

1250

Check to see if the square ahead is greater than zero (not the finish line).

1260

If the horse is not at the finish line, then check the square ahead in the lane inside the horse, the lane the horse is in, and the lane outside the horse, to see if there is another horse there. If there is another horse in any of those squares, then set the square available flag to false.

1270

If the horse is at the finish line, do nothing here. (The finish line is always available, no need to check for horses ahead.)

1280

Check to see if the square is available.

1290

If the square is available, then move the horse. Set the track lane and target square to the horse number. Set the track lane and square the horse was in to zero. Set the horse's square to the target square.

1300

If the square is not available, do nothing here. (The photo zone cannot move the horse ahead if it is blocked by another horse.)

1310

Check for photo finish to see if the horse just moved is at the finish line (square=0).

1320

If the horse is at the finish line, then: Set the photo finish flag to true. Set the track lane and square to zero. Add 1 to the number of photos. Set the photo position for the horse to one more than the number of horses who finished the race before this turn. Set the horse's move count to zero. Randomly select the photo place for this horse for this photo (distance from the finish line).

1330

If the horse is not at the finish line, do nothing here.

1340

If the horse is not in the photo zone, do nothing here.

1350

If the horse has already finished the race (square=0), do nothing here.

FIG. 10 Text

1400

Figurehead box for photo control process.

1410

Perform the photo process routine for all horses in the photo. (See FIG. 3)

1420

Initialize the more-photos flag to true, and perform the iteration until the more-photos condition is false.

1430

Test to see if there are more than one trailing horses in the photo just processed.

1440

If there are more than one trailing horse, this means that more photos have to be generated to determine the outcome of the trailing horses in the photo.

1450

Initialize next-photo-position to zero.

1460

Figurehead box for iteration to prepare the next photo.

1470

Repeat this iteration for each horse in the photo (except the first —we know the first horse will not be in the next photo). Test to see if the horse is at the finish line.

1480

If the horse is at the finish line, do nothing here.

1490

If the horse is not at the finish line, then process it for the next photo. If next-photo-position=0 (this is the first horse we found for the next photo), increment count of horses-finished to include all horses in the photo before this one (use the loop value for the current iteration); then set next-photo-position to horses-finished +1. (This is the finish position which this photo will determine.) Add 1 to the number of photos. Set the photo position for this horse (in the photo array) to the next-photo-position. Move the horse number into the photo array. Calculate the photo-place according to the following algorithm: ((Current photo place for this horse in the previous photo)−1)* ((random number from 1-10)/10)+0.9

1490 (cont'd)

This will generate a photo place from 1 to (photo place for this horse from the previous photo−1). This will force the horse to be at least one step closer to the finish line in the second photo than he was in the first.

1500

Perform the photo process routine for all the horses in the (new) photo. (See FIG. 5)

1510

If there is only one horse trailing, then there are no more photos to be generated. Increment horses-finished to include all horses in the photo. Set more-photos flag to false. Set start-photo to the number-of-photos+1. (This positions the photo array to the next available slot.)

FIG. 5 Text

1510'

Figurehead box for the photo process.

1520

Set horses-in-photo to number-of-photos—start-photo+1. Sort all the horses in this photo by their photo-place (lowest first). This puts the winning horse first. Initialize normalization factor to 1 less than the photo-place of the first horse. Set the trailing-horse count to zero.

1530

Figurehead box for iteration.

1540

Perform the iteration once for each horse in the photo.

1550

Normalize the photo-place by subtracting the normalization factor.

1560

Test for horse at the finish line.

1570

If the horse is not at the finish line, calculate the finish place by adding 1+ number of horse so far in the photo to the number of horses finished already. Add one to the trailing-horses count.

1580

If the horse is at the finish line, set the finish place to one more than the number of horses already finished. Test for a dead heat.

1590

If this is not the first horse in the photo, then there is a dead heat. Set thew dead heat flag to true for this horse and the first horse in the photo.

1600

If this is the first horse in the photo, then do nothing here.

Figure 17:
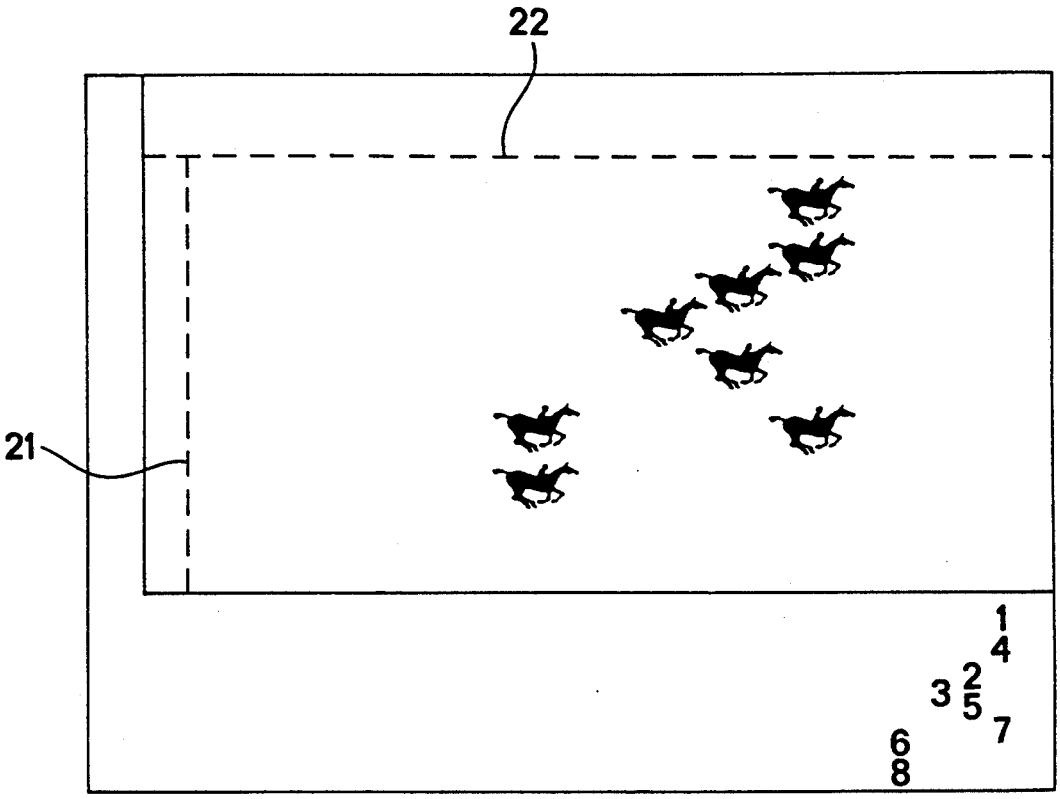
FIGS. 17-19 show various monitor screen displays during running of the game of FIGS. 1-10.
Figure 18:
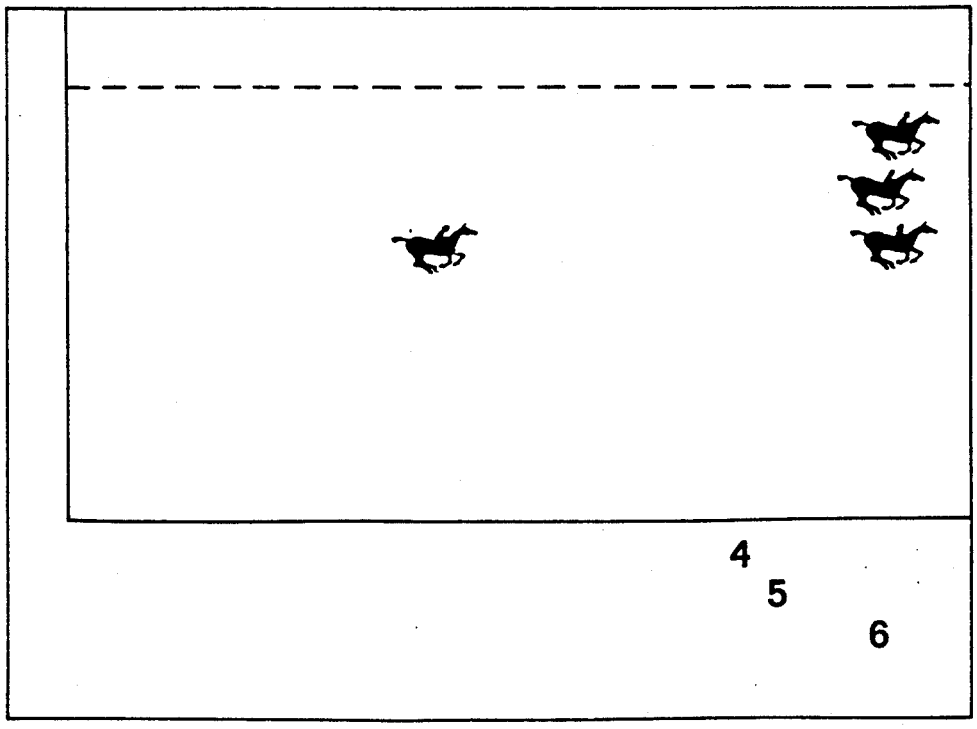
Figure 19:
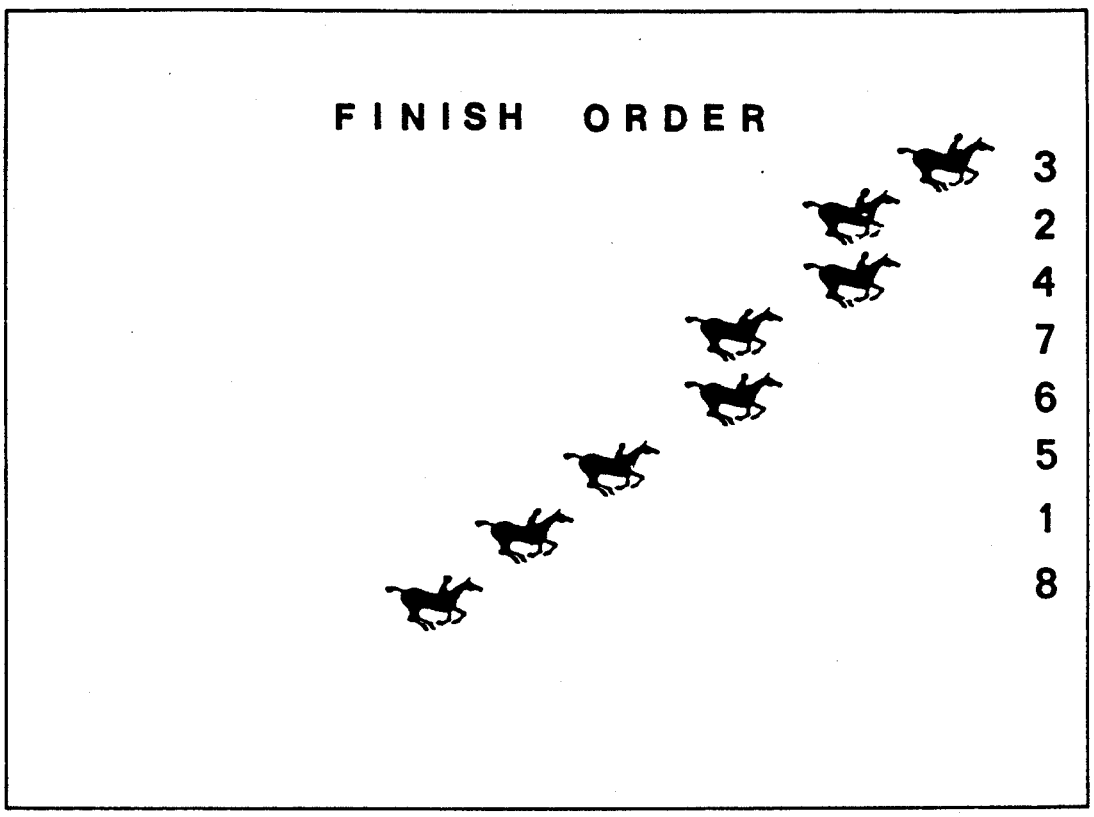

FIGS. 17, 18, and 19 show, respectively, a view of the display at just after the start gate has opened, at the finish line, and a summary end screen. In FIG. 17, the starting gate is shown at 21 with the rail at 22, and with 8 horses distributed over the track. The finish line in FIG. 18 shows three horses in a photofinish and one behind. Other slower horses are off the screen. FIG. 19 shows an end screen with the finish order. No. 3 horse was first, Nos. 2 and 4 were tied for second, and so on. The screens in FIGS. 17 and 18 also show at the bottom the numbers of the horses in their current order.

While the invention has been described in connection with preferred embodiments, it will be understood that modifications thereof within the principles outlined above will be evident to those skilled in the art and thus the invention is not limited to the preferred embodiments but is intended to encompass such modifications.

What is claimed is:

1. A computerized racing game comprising computer means including:

(a) means for displaying at least part of a race course and race contestants, (b) means for storing the positions of the contestants during the race, said means for storing comprising a two-dimensional array data structure having Y rows and X columns with the number of rows at least equal to the course length and the number of columns at least equal to the number of contestants, said array comprising contestant-occupiable locations and non-contestant-occupiable free spaces wherein a contestant on a move entering a free space is automatically moved forward to the next contestant-occupiable location, (c) means for moving said contestants in response to chance, weighted random events, or strategical inputs from players, (d) means for displaying the outcome of the racing game.

2. The racing game of claim 1, wherein the free spaces are clustered in a group to simulate a course turn.

3. The racing game of claim 1, wherein the free spaces are clustered in at least two spaced groups to simulate two course turns.

4. The racing game of claim 1, wherein the array includes a reserved column with non-contestant-occupiable locations for storing information relevant to the course conditions.

5. The racing game of claim 1, wherein said free spaces are distributed in the array such that more of them are located in columns on one side of the array than on the other side.

6. A computerized racing game comprising computer means including:

(a) means for displaying at least part of a race course having a finish line and race contestants, (b) means for moving said contestants in response to chance, weighted random events, or strategical inputs from players, (c) means for displaying the outcome of the racing game, (d) said means of (b) comprising means for determining those contestants within a certain distance from the race finish line and means for speeding up said contestants so that they appear to finish at substantially the same time.

7. The racing game of claim 6, wherein the contestants include within a certain distance from the finish line a leader and followers, and said means for moving includes means for providing extra moves for the followers for each move of the leader so that they appear to finish at substantially the same time.

8. A computerized racing game comprising computer means including:

(a) means for displaying at least part of a race course and race contestants, (b) means for moving said contestants in response to chance, weighted random events, or strategical inputs from players, (c) means for displaying the outcome of the racing game, (d) said means of (b) comprising means for smoothing out the display of the contestants as they move during the progress of the race.

9. The racing game of claim 8, wherein the smoothing means of (d) comprises means for sub-dividing the distance a contestant will move at each contestant move into smaller values and for executing the smaller values for each contestant interspersed with the moves of the other contestants until the total distance indicated by the move is executed.

10. A computerized racing game comprising computer means including:

(a) means for displaying at least part of a race course and race contestants, (b) means for storing the positions of the contestants during the race, said means for storing comprising an array generally mimicking the course layout, (c) means for moving said contestants in response to chance, weighted random events, or strategical inputs from players, (d) means for displaying the outcome of the racing game, (e) means for allocating to each contestant an array location representing the contestant's position on the course and array locations adjacent to the one occupied by said contestants for preventing another contestant from occupying said adjacent locations.

11. A computerized racing game comprising computer means including:

(a) means for displaying at least part of a race course having a finish line and race contestants, (b) means for storing the positions of the contestants during the race, (c) means for moving said contestants in response to chance, weighted random events, or strategical inputs from players, (d) means for displaying the outcome of the racing game, said means for displaying comprising, when at least three contestants are involved at the finish line, photofinish means comprising means for displaying a first photo showing the relative positions of at least two of the three contestants at the finish line, and means for displaying a second photo independent of the first showing the relative positions at the finish line of contestants other than the contestant shown in the lead in the first photo, whereby the plural photos clearly indicate the win, place or show contestants at the race finish.

12. The racing game of claim 11, wherein the means for storing comprises an array whose zero position represents the finish line.

* * * * *